US007004763B2

(12) United States Patent
Ma

(10) Patent No.: US 7,004,763 B2
(45) Date of Patent: Feb. 28, 2006

(54) BOARD-TO-BOARD ELECTRICAL CONNECTOR ASSEMBLY

(75) Inventor: Hao-Yun Ma, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/831,405

(22) Filed: Apr. 23, 2004

(65) Prior Publication Data

US 2004/0214457 A1 Oct. 28, 2004

(30) Foreign Application Priority Data

Apr. 23, 2003 (TW) ..... 92109512 A

(51) Int. Cl.
*H01R 9/09* (2006.01)

(52) U.S. Cl. ..... 439/74; 439/636

(58) Field of Classification Search ..... 439/74–75, 439/636, 660, 65

See application file for complete search history.

(56) References Cited

U.S. PATENT DOCUMENTS 5,205,741 A * 4/1993 Steen et al. ..... 439/70
5,539,619 A * 7/1996 Murakami ..... 361/785
5,882,212 A 3/1999 McHugh et al. ..... 439/74
5,915,976 A 6/1999 McHugh ..... 439/74
5,921,787 A * 7/1999 Pope et al. ..... 439/74
6,048,213 A * 4/2000 Lai et al. ..... 439/74
6,155,886 A 12/2000 Koseki et al. ..... 439/736
6,227,897 B1 * 5/2001 D'Agostino ..... 439/362

* cited by examiner

*Primary Examiner*—Michael C. Zarroli

(74) *Attorney, Agent, or Firm*—Wei Te Chung

(57) ABSTRACT

An electrical connector assembly (1) includes a first connector (2) and a second connector (3) for mating with the first connector. The first connector includes a housing (21) and a plurality of male contacts (22) and female contacts (23) received therein. The housing includes a mating surface (210) for mating with the second connector and a mounting surface (211) for connecting with a printed circuit board. A plurality of parallel slots (2101) is defined in the mating surface, and therefore a partition wall (2102) is formed between two adjacent slots. Furthermore, the width of the partition wall is substantially equal to the width of the slot. The male contacts and the female contacts are arranged in both side surfaces of each partition wall, and also in opposite inner surfaces of each slot. The second connector has substantially the same configuration as the first connector.

5 Claims, 4 Drawing Sheets

BOARD-TO-BOARD ELECTRICAL CONNECTOR ASSEMBLY

BACKGROUND OF THE INVENTION

1. Field of the Invention

The present invention relates to an electrical connector assembly for electrically connecting two separate substrates, such as printed circuit boards (PCBs).

2. Description of the Prior Art

Board-to-board electrical connector assemblies are widely used and applied in all kinds of electrical equipments to electrically connect two separate PCBs. Typically, such board-to-board electrical connector assembly has a rectangular housing and a plurality of contacts received therein, and examples thereof are disclosed in U.S. Pat. Nos. 5,882,212, 5,915,976 and 6,155,886.

FIG. 4 shows a conventional board-to-board connector assembly 8. The board-to-board connector assembly 8 comprises a first connector 6 and a second connector 7 mounted on two separated PCBs, respectively. The first connector 6 comprises a longitudinal first housing 60 and a plurality of first contacts 62 received therein, and the second connector 7 comprises a longitudinal second housing 70 and a plurality of second contacts 72 received therein. The first housing 60 has a rectangular configuration defining a first mounting surface 63 for being mounted on one of the PCBs and a first mating surface 64 for mating with the second connector 7. A longitudinal slot 61 is defined in the first mating surface 64 along a longitudinal direction of the first housing 60, and a plurality of first contacts 62 is secured in opposite inner surfaces of the slot 61 along the longitudinal direction of the first housing 60. The second housing 70 comprises a second mounting surface 73 and a second mating surface 74. A longitudinal protrusion 71 is defined on the second mating surface 74 along the longitudinal second housing 70 for engagingly inserted into the slot 61. A plurality of second contacts 72 is planted on two opposite side surfaces of the protrusion 71 along longitudinal second housing 70. The second contacts 72 each have a contacting portion 720 bending outward for connecting with a corresponding first contact 62.

In use, the first connector 6 and the second connector 7 are mounted on two separated PCBs, respectively. When the first connector 6 mates with the second connector 7, the protrusion 71 of the second connector 7 is engagingly received in the slot 61 of the first connector 6, and the first contacts 62 engage with responding second contacts 72 respectively. Therefore, the two separated PCBs are electrically interconnected via the connector assembly.

However, one problem with this type of electrical connector assembly is that the first connector 6 and the second connector 7 have different configurations, and the manufacturers have to use two different moulds to manufacture them, which inevitably increases the cost of manufacturing.

In view of the above, a new electrical connector which overcomes the above-mentioned disadvantages is desired.

SUMMARY OF THE INVENTION

Accordingly, an object of the present invention is to provide an electrical connector assembly having substantially the same configured first connector and second connector, therefore only one mould is needed to manufacture the connector assembly.

To achieve the above-mentioned object, an electrical connector assembly in accordance with a embodiment of the present invention comprises a first connector and a complementary second connector for mating with the first connector. The first connector comprises a housing and a plurality of male surface for mating with the second connector and a mounting surface for connecting with a printed circuit board. A plurality of parallel slots is defined in the mating surface, and therefore partition walls are formed between adjacent slots, furthermore, the width of the partition wall is substantially equal to the width of the slot. The male contacts and the female contacts are arranged in both side surfaces of each partition wall, and also in opposite inner surfaces of each slot. The second connector has substantially the same configuration as the first connector. Therefore, connector assembly for interconnecting two separated PCBs can be manufactured by only one mould, therefore, lower manufacturing cost of the connector assembly is achieved.

In use, when the first connector mates with the second connector, the partition walls of the second connector insert into corresponding slots of the first connector. The first contacts of the first connector engage with the second contacts of the second connector respectively, therefore, two separated PCBs are interconnected via the first connector and the second connector.

Other objects, advantages and novel features of the invention will become more apparent from the following detailed description when taken in conjunction with the accompanying drawings, in which:

DETAILED DESCRIPTION OF THE PREFERRED EMBODIMENT OF THE INVENTION

Figure 1:
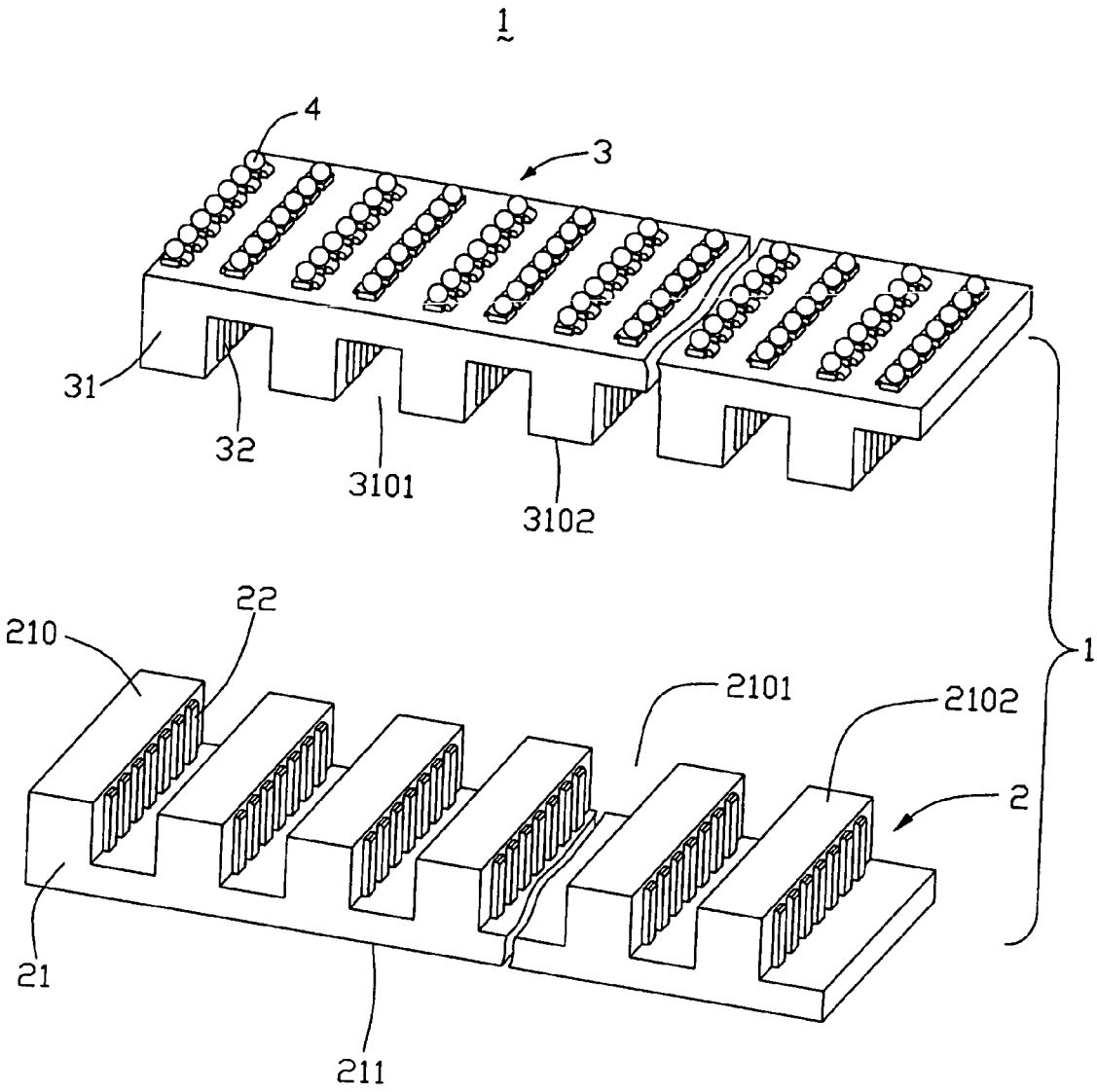
FIG. 1 is an exploded isometric view of an electrical connector assembly in accordance with an embodiment of the present invention.
Figure 2:
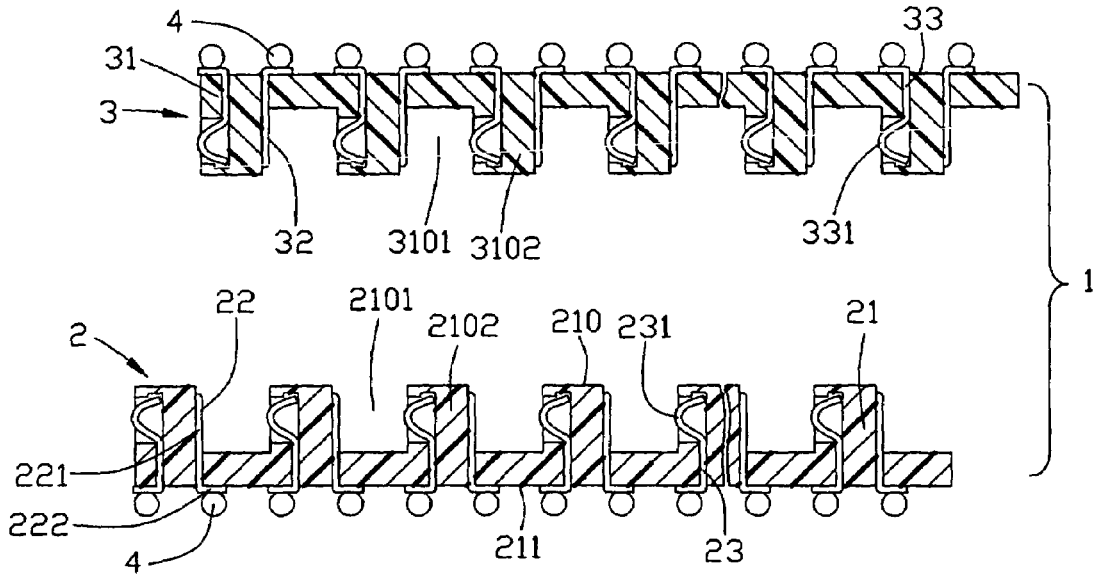
FIG. 2 is a cross-sectional view of the connector assembly, showing a first connector of the connector assembly ready to mate with a second connector of the connector assembly.
Figure 3:
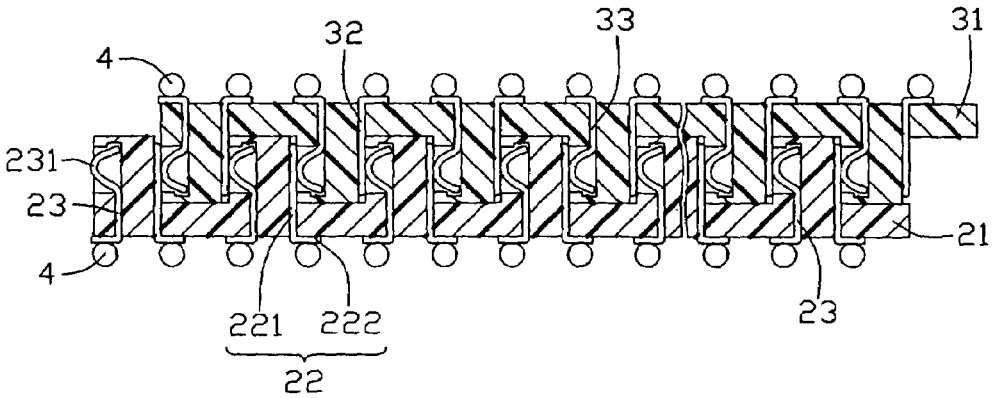
FIG. 3 is a cross-sectional view of the connector assembly, showing the first connector mating with the second connector.
Figure 4:
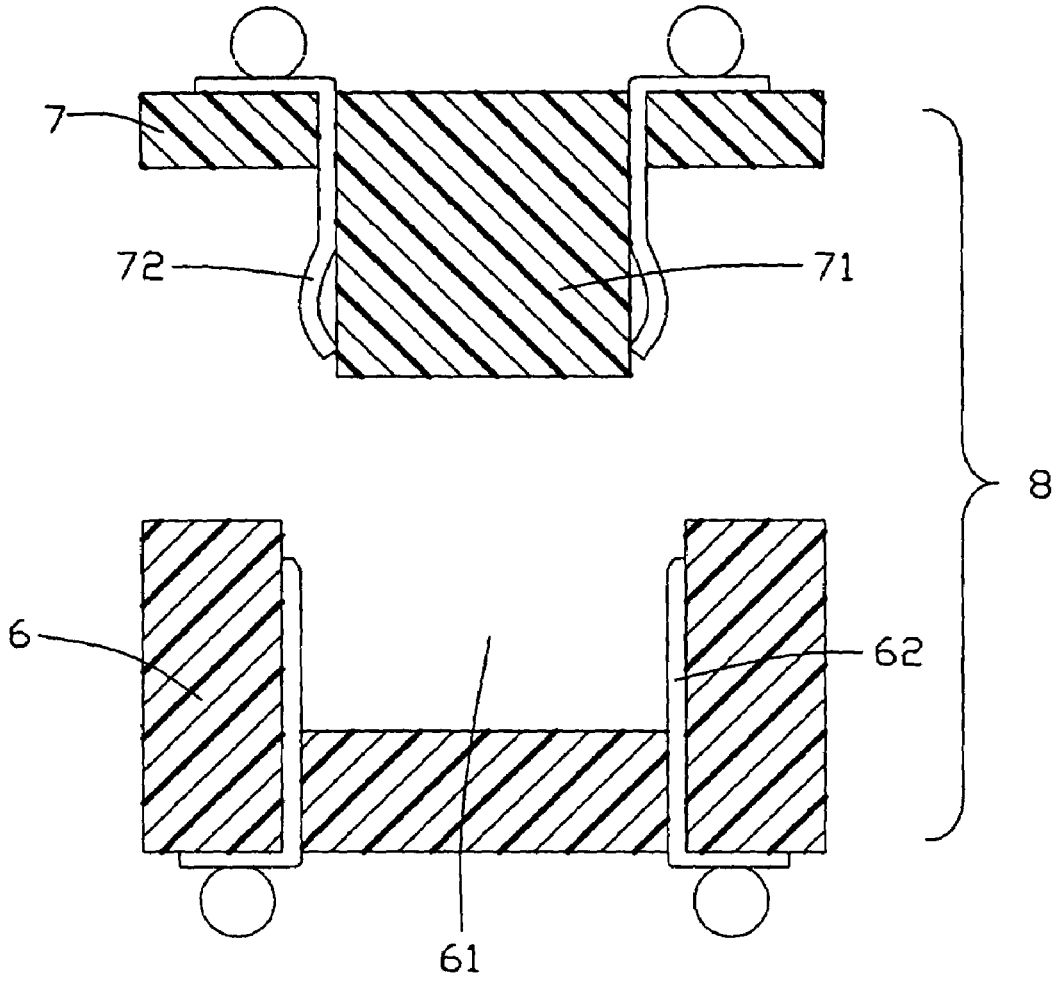
FIG. 4 (PRIOR ART)
FIG. 4 is a cross-sectional view of a conventional connector assembly, showing a first connector of the connector assembly ready to mate with a second connector of the connector assembly.

Reference will now be made to the drawings to describe the present invention in detail. Referring to FIGS. 1–3, an electrical connector assembly 1 in accordance with an embodiment of the present invention comprises a first connector 2 and a second connector 3 for mating with the first connector 1. The first connector 2 and the second connector 3 are mounted on two separated PCBs (not shown), respectively.

The first connector 2 comprises a first housing 21 and a plurality of male contacts 22 and female contacts 23 received therein. The first housing 21 comprises a mating surface 210 for mating with the second connector 3 and a mounting surface 211 for connecting with one of the PCBs. A plurality of parallel slots 2101 is defined in the mating surface 210, and therefore a partition walls 2102 is formed between adjacent slots 2101, furthermore, the width of the partition wall 2102 is substantially equal to a width of each slot 2101.

Each first male contacts 22 and the first female contacts 23 are arranged in both side surfaces of each partition wall 2102, and also in opposite inner surfaces of each slot 2101 respectively.

The first male contact 22 is substantially L shaped. It comprises a straight contacting portion 221 attached to an inner surface of the slot 2101, and a perpendicular soldering portion 222 extending out of the mounting surface 211 for carrying a soldering ball 4 thereof. The first female contact 23 is attached in an opposite inner surface of the slot 2101, and it comprises a first engaging portion 231 for engaging with the second connector 3 and a soldering portion for carrying a soldering ball 4. The first engaging portion 231 bends into the slot 2101, and the corresponding portion of the side surface defines a recess for providing a room for distortion of the engaging portion 231.

The second connector 3 has the same configuration as the first connector 2, and it comprises a second housing 31 and a plurality of second male contacts 32 and female contacts 33 received therein. The second housing 31 also comprises a plurality of second slots 3101 and second partition walls 3102. The contacts are arranged in the same manner as the contacts of the first connector 2.

In use, the first connector 2 mates with the second connector 3, and the second partition walls 3102 of the second connector 3 insert into the first slots 2101 of the first connector 2, and the first partition walls 2102 of the first connector 2 insert into the second slots 3101 of the second connector 3. Because the width of the partition wall is substantially equal to the width of the slot, the first male contacts 22 engage with the second female contacts 33, and the first female contacts 23 engage with the second male contacts 32. The first connector 2 and the second connector 3 are connected with a printed circuit board respectively via the soldering balls 4, therefore the two separated printed circuit boards are connected by the connector assembly 1.

Because the first connector 2 and the second connector 3 has substantially the same configuration, only one mould is need in manufacturing, therefore lower cost is achieved through the present invention.

Figure 5:
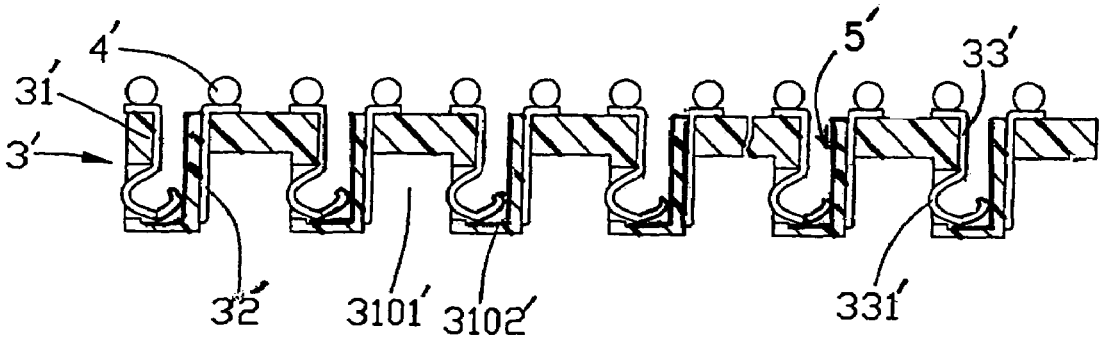
FIG. 5 is a cross-sectional view of another embodiment of the instant invention.

FIG. 5 shows another embodiment wherein the connector 3' including an insulative housing 31' defining a plurality of parallel slots 3101'. One row of resilient contacts 33' and the other row of rigid contacts 32' are exposed by two sides of each slots 3101', wherein the contact portion 331' of the resilient contact 33' extends into the slot 3101', and the partition wall 3102' defines a passageway 5' to allow the corresponding resilient contact 33' installed into the housing 31' from the bottom face in the traditional way. The tails of the pair of the resilient contact 33' and the corresponding rigid contact 32' which are commonly spaced by the same partition wall 3102', extends in opposite horizontal directions with the solder balls 4' thereon under a condition that the corresponding passageway 5' of the same partition wall 3102' separates said pair of the resilient contact 33' and rigid contact 32'.

While preferred embodiment in accordance with the present invention has been shown and described, equivalent modifications and changes known to persons skilled in the art according to the spirit of the present invention are considered within the scope of the present invention as defined in the appended claims.

What is claimed is:

1. An electrical connector assembly comprising:

a connector including:

an insulative housing defining thereof lengthwise and lateral directions perpendicular to each other;

a plurality of parallel elongated slots side by side arranged with one another along the lengthwise direction while each of said elongated slots extends along the lateral direction;

plural rows of resilient contacts and plural rows of rigid contacts being alternately arranged along said lengthwise direction; wherein one row of resilient contacts is positioned by one side of each of said slots; and one row of rigid contacts positioned by the other side of each of said slots.

2. The connector assembly as claimed in claim 1, wherein the row of resilient contacts and the row of rigid contacts sharing the same slot, define two rows of horizontal tails extending toward each other.

3. The connector assembly as claimed in claim 1, wherein the row of resilient contacts and the row of rigid contacts separated by a partition wall define two rows of horizontal tails extending away from each other.

4. The connector assembly as claimed in claim 3, wherein the partition wall defines a passageway into which the resilient contacts is installed.

5. The connector assembly as claimed in claim 1, wherein another similar connector is mated with the connector under a condition that the rigid contacts of the connector are mate with resilient contacts of said another connector and the resilient contacts of the connector are mate with rigid contacts of said another connector.

* * * * *